United States Patent [19]

Moertel

[11] 4,175,104

[45] Nov. 20, 1979

[54] MOLDED ELEMENT TAPE SUPPORT FOR INVISIBLE SLIDE FASTENER AND METHOD OF MANUFACTURE

[75] Inventor: George B. Moertel, Conneautville, Pa.

[73] Assignee: Textron Inc., Providence, R.I.

[21] Appl. No.: 877,531

[22] Filed: Feb. 13, 1978

Related U.S. Application Data

[62] Division of Ser. No. 724,222, Sep. 17, 1976, Pat. No. 4,080,691.

[51] Int. Cl.[2] ..... B29D 5/00

[52] U.S. Cl. ..... 264/103; 24/205.13 D; 264/251; 264/296; 425/814

[58] Field of Search ..... 264/103, 251, 252, 296; 425/DIG. 814, DIG. 34; 24/205.13 R, 205.13 D

[56] References Cited

U.S. PATENT DOCUMENTS

| | | | |
|---|---|---|---|
| 3,069,723 | 12/1962 | Porepp | 264/252 X |
| 3,086,246 | 4/1963 | Stone | 264/252 X |
| 3,696,473 | 10/1972 | Jones | 24/205.13 R |
| 4,033,014 | 7/1977 | Manning | 24/205.13 D |

FOREIGN PATENT DOCUMENTS

| | | | |
|---|---|---|---|
| 307947 | 9/1955 | Switzerland | 264/252 |

*Primary Examiner*—Thomas P. Pavelko
*Attorney, Agent, or Firm*—O'Brien and Marks

[57] ABSTRACT

Each stringer of a slide fastener includes a plurality of spaced coupling elements, molded on continuous connecting threads, with wing portions extending into the spaces between the legs of coupling elements on the upper side thereof. The stringer tape weft threads are looped over the connecting threads and pass over the edges of the wing portions adjacent the heads of the coupling elements while a number of the warp threads interwoven with the weft threads overlie the legs and wing portions to form a slide fastener chain with hidden or invisible elements.

8 Claims, 9 Drawing Figures

FIG. 1
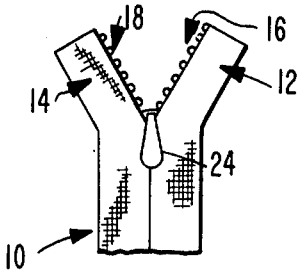
FIG. 2
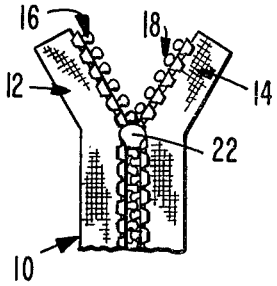
FIG. 3
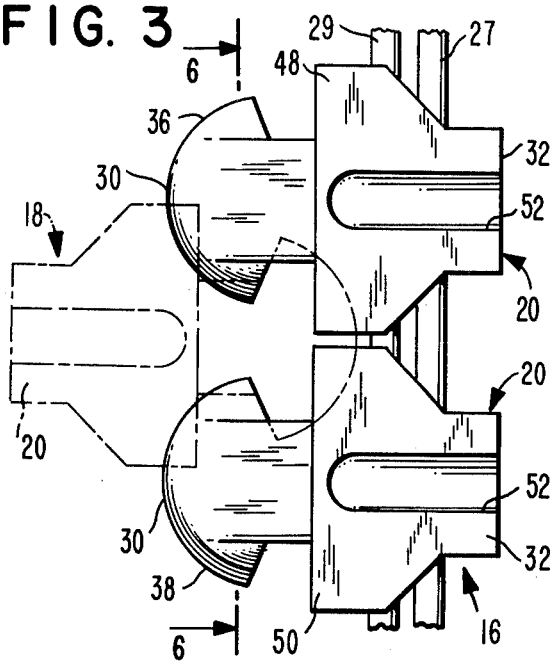
FIG. 4
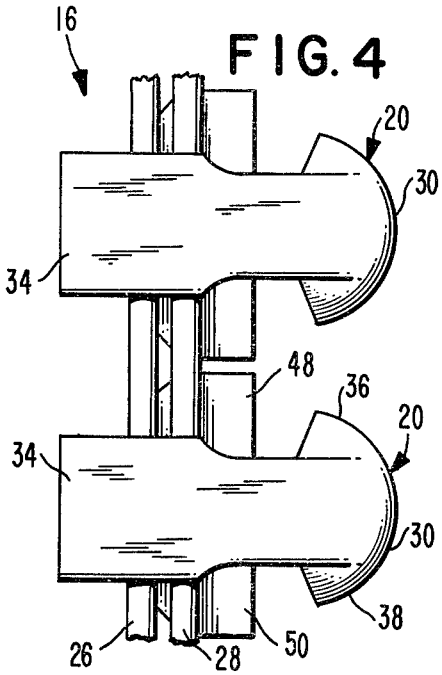
FIG. 5
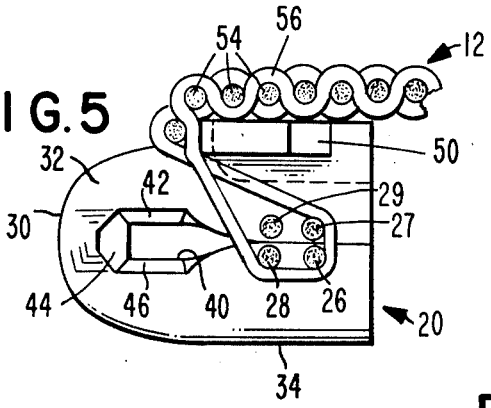
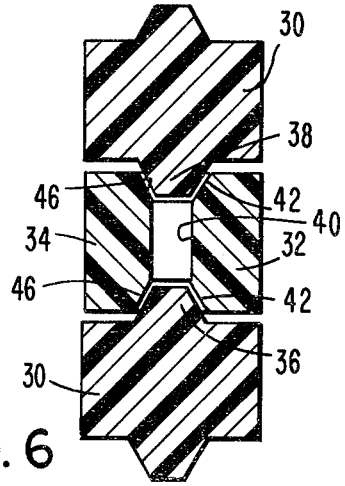
FIG. 6

FIG. 7
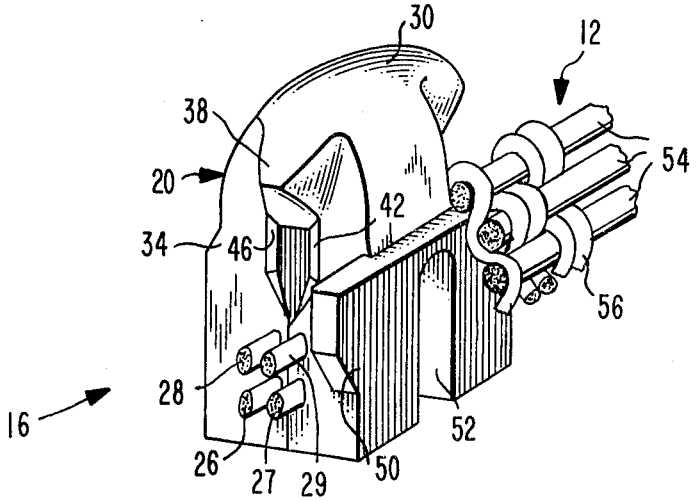
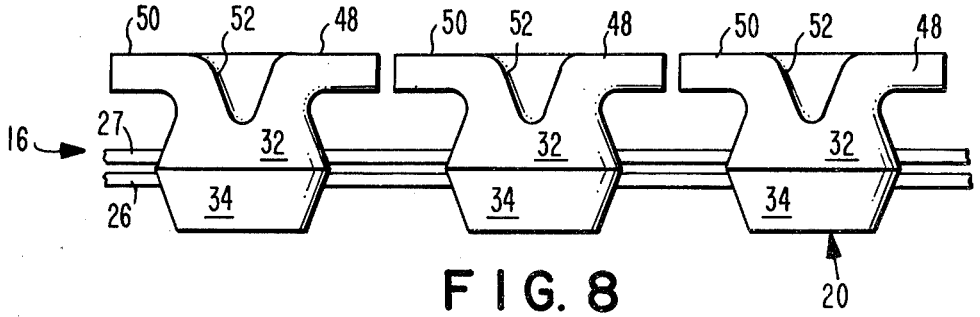
FIG. 8
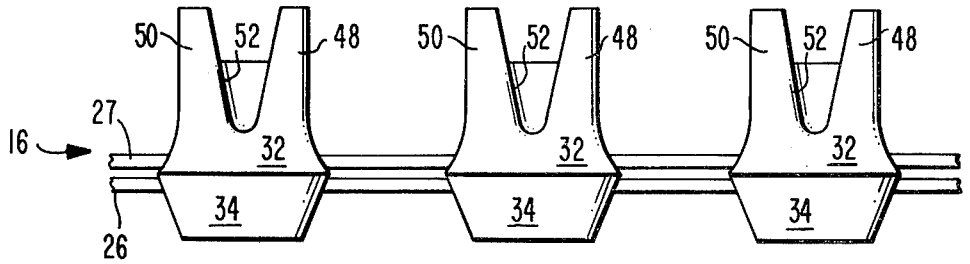
FIG. 9

MOLDED ELEMENT TAPE SUPPORT FOR INVISIBLE SLIDE FASTENER AND METHOD OF MANUFACTURE

BACKGROUND OF THE INVENTION

1. Field of the Invention

This application is a division of Ser. No. 724,222, 09/17/76; now U.S. Pat. No. 4,080,691.

The present invention relates to slide fasteners with hidden coupling elements, and in particular, to such slide fasteners and their method of manufacture in which the coupling elements are formed in trains connected together by threads.

2. Description of the Prior Art

The prior art is generally cognizant of the invisible-element slide fasteners in which the coupling elements are formed in trains on coupling threads, such as that described in U.S. Pat. No. 3,696,473, wherein the elements are stitched to a folded tape and have projections extending into spaces between the elements to prevent lateral slipping and exposure of the elements. In U.S. Pat. No. 3,855,673, a slide fastener stringer of continuous filament type is disclosed which includes laterally extending barbs to securely contain the knots of two-thread double-locked stitches. U.S. Pat. No. 3,179,996 describes a concealed slide fastener in which a cord carrying the coupling elements is secured to the tape by having the weft threads of the tape extend around the cord and in which two flaps of the tape conceal portions of the elements. Additionally, U.S. Pat. No. 3,068,541 discloses a one sided fastener with scoops molded onto one side of a tape with beads. Illustrations of other types of coupling elements are found in U.S. Pat. Nos. 1,785,240 and 3,302,259.

SUMMARY OF THE INVENTION

The invention is summarized in that a woven slide fastener stringer includes a train of coupling elements having connecting thread means and a plurality of polymer coupling elements molded on the connecting thread means, each of the coupling elements having a head portion and leg means extending from the head portion, the connecting thread means having spaced segments imbedded in the respective leg means, the coupling elements further having wing portions extending into the spaces between the leg means of adjacent coupling elements on an upper side of the coupling elements, a woven tape having a plurality of warp threads and a weft thread interwoven with the plurality of warp threads, some of the plurality of warp threads overlying the upper side of the leg means and the wing portions, and the weft thread extending around the connecting thread means and over the edge of the wing portions adjacent the head portions.

An object of the invention is to construct a slide fastener wherein a pair of trains of molded coupling elements are woven with a pair of tapes in a manner producing a fastener with concealed coupling elements.

Another object of the invention is to provide wing portions on the upper sides on coupling elements between legs thereof to hold the inner edges of mounting tapes together.

It is yet another object of the present invention to provide such a slide fastener in which the coupling elements have a double engagement configuration to prevent rotational movements of the coupling elements.

One feature of the invention is the formation of wing portions during molding to project upward from the elements and then the subsequent bending of the wing portions to extend between the coupling elements.

An advantage of the invention is the elimination of a folded back edge portion of a support tape necessary to attach coupling elements in previous slide fasteners.

Yet other objects, features and advantages of the present invention will become apparent from the following description of the preferred embodiment when taken in conjunction with the accompanying drawings.

BRIEF DESCRIPTION OF THE DRAWINGS

FIG. 1 is a plan view of a slide fastener constructed according to the present invention.

FIG. 2 is a bottom view of the slide fastener of FIG. 1.

FIG. 3 is a top view of a portion of one coupling element train of the slide fastener of FIG. 1 with a mating train illustrated in dashed lines.

FIG. 4 is a bottom view of the one coupling element train portion of FIG. 3

FIG. 5 is a front cross-sectional view of a portion of a right stringer in the fastener of FIG. 1.

FIG. 6 is a cross-sectional view taken along the line 6—6 in FIG. 3.

FIG. 7 is a perspective view of a cut-away portion of the slide fastener stringer of FIG. 5.

FIG. 8 is a right side view of the slide fastener element train of FIG. 3

FIG. 9 is a view similar to FIG. 8 but at an intermediate step in the fabrication of the slide fastener element train.

DESCRIPTION OF THE PREFERRED EMBODIMENT

As shown in FIGS. 1 and 2, the present invention is embodied in a slide fastener generally indicated at 10 and including a pair of woven mounting tapes generally indicated at 12 and 14 and arranged planarly side-by-side. Attached to the edge of each of the mounting tapes 12 and 14 adjacent the other tape is a respective one of a pair of continuous fastener trains indicated generally at 16 and 18 each of which includes a plurality of thermoplastic molded coupling elements generally indicated at 20 in FIGS. 3–8. A slider 22 is slidably mounted on the trains 16 and 18 and is provided with a pull tab 24 so that the slider 22 may be pulled upward and downward to progressively engage and disengage the respective coupling elements 20 of the two trains 16 and 18. As viewed in FIG. 1, the tape 12 and train 16 define a right stringer while the tape 14 and train 18 define a left stringer; the right and left stringers together define a slide fastener chain.

Only the train 16 and tape 12 are shown in detail in FIGS. 3 through 9 but it should be understood the right and left stringers are substantial mirror images of each other and that all of the detail in the description of the train 16 and tape 12 applies equally to the train 18 and tape 14.

As can best be seen in FIGS. 3, 4 and 5, each of the coupling elements 20 includes a head portion 30 and a pair of generally parallel upper and lower legs or leg portions 32 and 34 which extend in generally the same direction from top and bottom sides of the head portion 30. The coupling elements 20 of the train 16 are joined together by coupling or connecting threads 26, 27, 28 and 29 which have spaced segments imbedded in the respective leg portions 32 and 34 such as by the coupling elements being molded on the connecting threads. Formed on the front and back sides of the head portion 30 are respective locking protrusions 36 and 38 which extend generally laterally outward therefrom. Between the legs 32 and 34 contiguous head portion 30, a recess 40 is formed extending completely transversely through the coupling element 20. A series of inwardly sloped engagement surfaces, such as canted, planar engagement surfaces 42, 44 and 46, are formed on the inside edges of the coupling element 20 bordering the recess 40; the engagement surface 42 being on the leg 32, the engagement surface 44 being formed in the head portion 30, and the engagement surface 46 being formed on the inside of the leg 34.

Extending outward from the opposite sides of the upper portion of the leg 32 are respective projections or wing portions 48 and 50 which have generally flat upper surfaces extending the upper surface of the leg 32 in both lateral directions. The wing portions 48 and 50 are formed above the connecting threads 26, 27, 28 and 29 in spaced relationship thereto. Also, the wing portions 48 and 50 are shaped and dimensioned so that each of the wing portions 48 and 50 reaches into the space between coupling elements almost to the wing portion 48 or 50 of the adjacent element 20. Toward the heels of the coupling elements 20, the wing portions 48 and 50 taper from their full extended dimension back toward the main body of the coupling element 20. The edges of the wing portions 48 and 50 adjacent the head portions 30 extend in a line parallel to connecting threads 26, 27, 28, and 29. A longitudinal groove 32 is formed in the upper surface of the leg 32 between the wing portions 48 and 50.

The means of attachment of the train 16 with the coupling elements 20 to the mounting tape 12 can be best seen in FIGS. 5 and 7. The mounting tape 12 is formed of a series of warp threads 54 and a weft thread 56 interwoven with the warp threads. Some of the warp threads 54 that are directly adjacent the edge of the mounting tape 12 overlie the upper surfaces of the legs 32 and the wing portions 48 and 50. The weft thread 56 loops or extends around the connecting threads 26, 27, 28 and 29 and extends or passes over the edge of the wing portions 48 and 50 adjacent the head portions 30.

In the operation of the slide fastener installation 10, the slider 22 is pulled upward and downward to progressively engage and disengage the respective coupling elements 20 of the chains 16 and 18. The coupling of the coupling elements 20 of the chains 16 and 18 when they are engaged is best shown in FIGS. 3 and 6. In FIG. 3, one of the coupling elements 20 of the chain 18 has been illustrated in broken lines to show the relative positioning of the coupling elements 20 of the chains 16 and 18 when they are interlocked. The head portions 30 of each of the coupling elements 20 of each chain are received between two coupling elements 20 of the other chain in the general area of their recesses 40. As can best be seen in FIG. 6, the engagement surfaces 42, 44 and 46 of each of the coupling elements 20 of each chain are in controlled engagement with the locking protrusions 36 and 38 extending from the head portions 30 of the coupling elements 20 of the other chain. In this way each of the coupling elements 20 of each chain has two engagements with the adjacent coupling elements 20 of the other chain, one in which its recess 40 receives the locking protrusions 36 and 38 from the other coupling elements and one in which its locking protrusions 36 and 38 are received in the recesses 40 of the other coupling elements. Because these two engagements are arranged some distance from each other on each coupling element, they prevent any substantial rotational or any tilting movement of any coupling element 20 relative to the coupling elements in the opposite chain.

As can best be visualized from the drawing of FIG. 3, the wing portions 48 and 50 of all of the coupling elements 20 in each chain cooperate to form a semi-continuous tape supporting shelf extending the length of the chain 16 and 18. The warp threads 54 and interwoven weft thread 56 adjacent the edge of the mounting tapes are supported or maintained in overlying position by this shelf throughout the length of these chains to hide or conceal most of the body of the coupling elements 20, as can be seen in FIG. 1. This support is obtained without any corresponding loss in flexibility in the fasteners; the gaps between the wing portions 48 and 50 of adjacent coupling elements 20 are still large enough to allow flexibility between coupling elements but small enough not to permit weft thread 56 to freely pass through such gaps.

The trains 16 and 18 are woven into the mounting tapes 12 and 14 during weaving of the tapes; the weft threads 56 being looped around the connecting threads 26, 27, 28 and 29 at that time. This secures the strings to the mounting tapes integrally, securely, and permanently without the need for any separate attachment, stitching threads or any folded tape.

In the method of forming wing portions 48 and 50, the coupling elements 20 may be initially manufactured in one of the two ways, either (1) molding them in their configuration of FIG. 9 or (2) molding them flat with the legs 32 and 34 extending outward in opposite directions from the head portion 30 and then folding the legs to extend in the same direction; in either method it is more practical for the wing portions 48 and 50 to be initially formed extending upward, as shown in FIG. 9. Then after weaving the tape 12 with the coupling elements 20 oriented at an angle to the direction of the weft thread needle or shuttle movement (i.e. the train 16 rotated about its longitudinal axis through an angle in the range of about 135° to 170° clockwise relative to the tape 12 being formed in FIG. 5), the wing portions 48 and 50 are heated and folded by apparatus suitable for that purpose to the horizontal configuration as shown in FIG. 8. Alternately the wing portions 48 and 50 may be bent before weaving. The groove 52 is provided between the wing portions 48 and 50 to facilitate the bending over of the wing portions 48 and 50 to their horizontal position. Thereafter the train 16 is rotated to its position illustrated in FIG. 5 with the tape 12 overlying the wing portion 48 and 50 and the leg portion 32.

Inasmuch as the disclosed fastener is subject to many modifications, variations, and changes in detail, it is intended that all the material in the foregoing description and shown in the accompanying drawings be interpreted as illustrative, and not in a limiting sense.

What is claimed is:

1. A method of forming a slide fastener stringer comprising the steps of joining a plurality of spaced coupling elements having a body to at least one connecting thread, forming wing portions on an upper surface of each body, bending the wing portions of each body toward the wing portions of the next body thereby forming a substantailly continuous linear tape support, weaving a woven tape to each body with threads thereof overlying and covering the wing portions with selected ones of said threads being secured to said connecting thread for uniting the body, the tape and said connecting thread together thereby concealing the linear support and coupling elements.

2. A method as claimed in claim 1 wherein the joining step is formed by molding the coupling elements to the connecting threads.

3. A method as claimed in claim 1 wherein the bodies of the respective coupling elements are molded in a flat condition with a pair of leg portions extending on opposite sides of a head portion and being molded over respective connecting threads of a pair of connecting threads, and the leg portions are subsequently bent prior to the weaving step to extend in the same direction from the head portion.

4. A method as claimed in claim 1 wherein the bodies of the respective coupling elements are molded in a flat condition with a pair of leg portions extending on opposite sides of a head portion and being molded over respective connecting threads of a pair of connecting threads, disposing an edge of said wing portions adjacent a head portion and extending generally parallel to said conecting thread, and extending said selected ones of said threads from said one edge of the wing portions adjacent the head portion around the connecting thread and returning the said one edge.

5. The method of claim 1 wherein the weaving step is performed after the bending step.

6. A method as claimed in claim 1 wherein each coupling element is formed with a pair of wing portions extending outward from the train, and the wing portions are subsequently bent in opposite directions into the spaces between the coupling elements.

7. A method as claimed in claim 6 wherein the bending step is performed before the weaving step.

8. A method as claimed in claim 6 wherein the bending step is performed after the weaving step.

* * * * *